US012796798B2

(12) United States Patent
Zemsky

(10) Patent No.: US 12,796,798 B2
(45) Date of Patent: Nov. 17, 2026

(54) LUMBER CARRYING AND SECURING DEVICE

(71) Applicant: Eric Zemsky, Hewitt, NJ (US)

(72) Inventor: Eric Zemsky, Hewitt, NJ (US)

( * ) Notice: Subject to any disclaimer, the term of this patent is extended or adjusted under 35 U.S.C. 154(b) by 1093 days.

(21) Appl. No.: 17/949,316

(22) Filed: Sep. 21, 2022

(65) Prior Publication Data

US 2024/0090651 A1 Mar. 21, 2024

(51) Int. Cl.

| | |
|---|---|
| ***A45F 3/14*** | (2006.01) |
| ***A45F 5/10*** | (2006.01) |
| *A45F 5/00* | (2006.01) |

(52) U.S. Cl.

CPC ..... *A45F 3/14* (2013.01); *A45F 5/10* (2013.01); *A45F 2003/142* (2013.01); *A45F 2005/1013* (2013.01); *A45F 5/1566* (2025.01)

(58) Field of Classification Search

CPC .. A45F 3/14; A45F 5/10; A45F 5/1566; A45F 2003/142; A45F 2005/1013

See application file for complete search history.

(56) References Cited

U.S. PATENT DOCUMENTS

| | | | | |
|---|---|---|---|---|
| 2,838,202 | A * | 6/1958 | Huether | A47G 23/0266 220/759 |
| 4,754,996 | A * | 7/1988 | Tecca | B63C 11/22 294/169 |
| 6,003,205 | A * | 12/1999 | Dehaven | B65D 23/106 220/759 |
| D615,366 | S * | 5/2010 | Berezansky | D7/622 |
| 8,443,467 | B2 | 5/2013 | Chiang | |
| 8,616,600 | B2 | 12/2013 | Owen | |
| 8,899,644 | B2 * | 12/2014 | Hancey | A45F 5/10 294/157 |
| 10,870,515 | B2 * | 12/2020 | Pearce | B65D 23/0871 |
| 2013/0032557 | A1 * | 2/2013 | Porath | A45C 9/00 211/85.7 |
| 2017/0119121 | A1 * | 5/2017 | Munoz | A45F 3/04 |

OTHER PUBLICATIONS

"Prescott Plastics 8 Pack : 1 ¾ Inch Round Black Vinyl End Cap, Flexible Pipe Post Rubber Cove." https://www.dropbox.com/s/cpd9brvyg2i6a99/Prescott%20Plastics%208%20Pack%201%203_4%20Inch%20Round%20Black%20Vinyl%20End%20Cap%2C%20Flexible%20Pipe%20Post%20Rubber%20Cover%20-%20Walmart.com.pdf?dl=0 [Date accessed: May 24, 2022].

Ski Carrier Strap Pole Carrier Ski Snowboard Shoulder Carrier Adjustable Ski Gear Accessory, Tomtop.com. https://www.tomtop.com/p-y18975.html [Date accessed: May 24, 2022].

* cited by examiner

*Primary Examiner* — Stephen A Vu

(57) ABSTRACT

A dual-ended cup based lumber carrier has oppositely disposed cups for receiving an end of elongated pieces of lumber or other materials between the cups. The cups are removably attached to one another at a varying length by way of a strap which extends to/around the cups. A transverse strap is attached to the afore-described strap. Removable connectors allow the transverse strap to extend around and hold the lumber together. The combination of cups and straps bundles the lumber and a carrying strap can be connected thereto allowing for easier and safer transport of the lumber compared to carrying without the devices disclosed herein.

15 Claims, 4 Drawing Sheets

LUMBER CARRYING AND SECURING DEVICE

FIELD OF THE DISCLOSED TECHNOLOGY

The disclosed technology relates generally to carrying devices and more specifically, to a device for bundling and capping multiple objects for carrying.

SUMMARY OF DISCLOSED TECHNOLOGY

A dual-ended cup based lumber carrier of embodiments of the disclosed technology has two hollow cylinders made of flexible material having a single open circular side, the single open circular side of each of the hollow cylinders proximal and spaced apart from each other. A strap extends around a distal side of each of the two hollow cylinders and is slidable or fixedly attached thereto the strap forming and adjustably sized closed loop.

In some embodiments two connecting mechanisms on the adjustably sized close loop are spaced apart from each of the two hollow cylinders. Therewise a second closed loop of flexible material can be attached to each of the connecting mechanisms. The second closed loop is within an identical plane (such as a vertical plane when looking in a direction which is through the loops or in the Z-axis when looking towards a back side of a cup) with the adjustably sized closed loop such that openings surrounded by the respective loops are facing in a same orientation.

A transverse loop can be fixedly connected to the strap equidistant between and parallel to each round side wall of each of the two hollow cylinders. In embodiments of the technology, a maximum distance between each of the two hollow cylinders is determined based on a length of the strap extending around the distal side of each of the two hollow cylinders. Each of the two hollow cylinders can be fixedly or slidably connected to said strap. "Fixedly" is defined as "retains connection and positioning during normal use of the device or is designed to do so" while "slidably" is defined as "able to move through a loop or have a strap move through a loop of a device."

Describe another way, two end cups each with an open front side and closed back side face each other. Portals are on the front sides, such as only on the front side. The back side can have a loop creating a portal fixedly attached to the cup where an adjustable length flexible strap passes through each of the portals on the closed back side. "Flexible" is defined as "able to change shape with human force without breaking." "Strap" is defined as "a length of material." A transverse flexible strap (transverse to the prior-described strap around the cups) can be fixedly attached to the adjustable length flexible strap forming a loop equidistantly connected between each of the two end cups.

Each of the open front sides can have a circular cross-section. The adjustable length flexible strap, in some embodiments, extends around oppositely disposed sides of a side wall of each end cup. The "side wall" is a wall between the front and back sides of the cup, such as a cylindrical side made of multiple circular cross-sections. Prism-shaped lumber or other lumber can be placed between, and inserted into, each of the two end cups. The lumber can be any length of wood, metal, plastic (e.g. PVC pipe) or other material such as a commonly used 2×4 or 2×6 known in the industry. The lumber can be of any width or circumference which fits within the two end caps, being a single piece of lumber or multiple separate pieces in combination.

A handle, in embodiments of the disclosed technology, is slidably connected or fixed, at two spaced apart positions, to the adjustable length flexible strap. The adjustable length flexible strap is slidably connected to the oppositely disposed sides of the side wall of each end cap in such an embodiment. The circular cross-section is deformable by way of a circumferentially placed draw string adapted to tighten at least one of the end caps around the prism-shaped lumber.

A dual-ended cup based lumber carrier system using devices described above has two identical end cups with an open end opposite a closed end. Two adjustable length flexible straps fixed at a center point of each two adjustable length flexible straps in a transverse manner to each other form a first length of strap for placing around the end caps and a second length of strap for forming a circular loop around lumber. The dual-ended cup based lumber carrier is adapted to carry lumber placed within each open end of each of the two identical end cups when one of the two adjustable length flexible straps is passed through each loop fixed to the closed end of each of the two identical cups.

A first adjustable strap of the two adjustable length straps is attached to itself by way of a removable connector forming a length of substantially double of the length of lumber desired to be placed or placed within each open end of each said end cup. A second adjustable strap of the two adjustable length flexible straps is formable into a closed loop having a diameter substantially equal to each open end of each end cup. A single or multiple pieces of lumber can be placed therein the cups. Each of the two loops of the first adjustable strap is equidistant from the center point (relative to one another) in embodiments of the disclosed technology. The dual-ended cup based lumber carrier can have a vertical line of symmetry passing at a halfway point between the cups.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

A dual-ended cup based lumber carrier has oppositely disposed cups for receiving an end of elongated pieces of lumber or other materials between the two oppositely disposed cups. The cups are removably attached to one another at a varying length thereto using a strap which extends through loops on a back/flat side of one or both of the cups. That is, the cups are slidably attached to each other via a strap which slides through a portal on a back (outer) side of one or both of the cups. This strap has an adjustable length to accommodate different length lumber. A transverse strap is removably or fixedly attached to the afore-described strap in a fixed manner at a 90 degree angle thereto with a removably connector on each end of the transverse strap. The removable connector can be used to secure the lumber carrier circumferentially around the lumber, the lumber simultaneously placed within the caps at either end of the lumber. The circumferential sections of each cap and the transverse strap can be in parallel planes to each other.

For purposes of this disclosure "fixed" or "fixedly" is defined as "designed to remain together during ordinary usage thereof and requiring structural damage or cutting to remove." Conversely the term "removable" or "removably" is defined as "designed to attach and detach as often as desired during ordinary usage thereof without requiring structural damage or cutting to detach."

Embodiments of the disclosed technology will become more clear in view of the following description of the figures.

Figure 1:
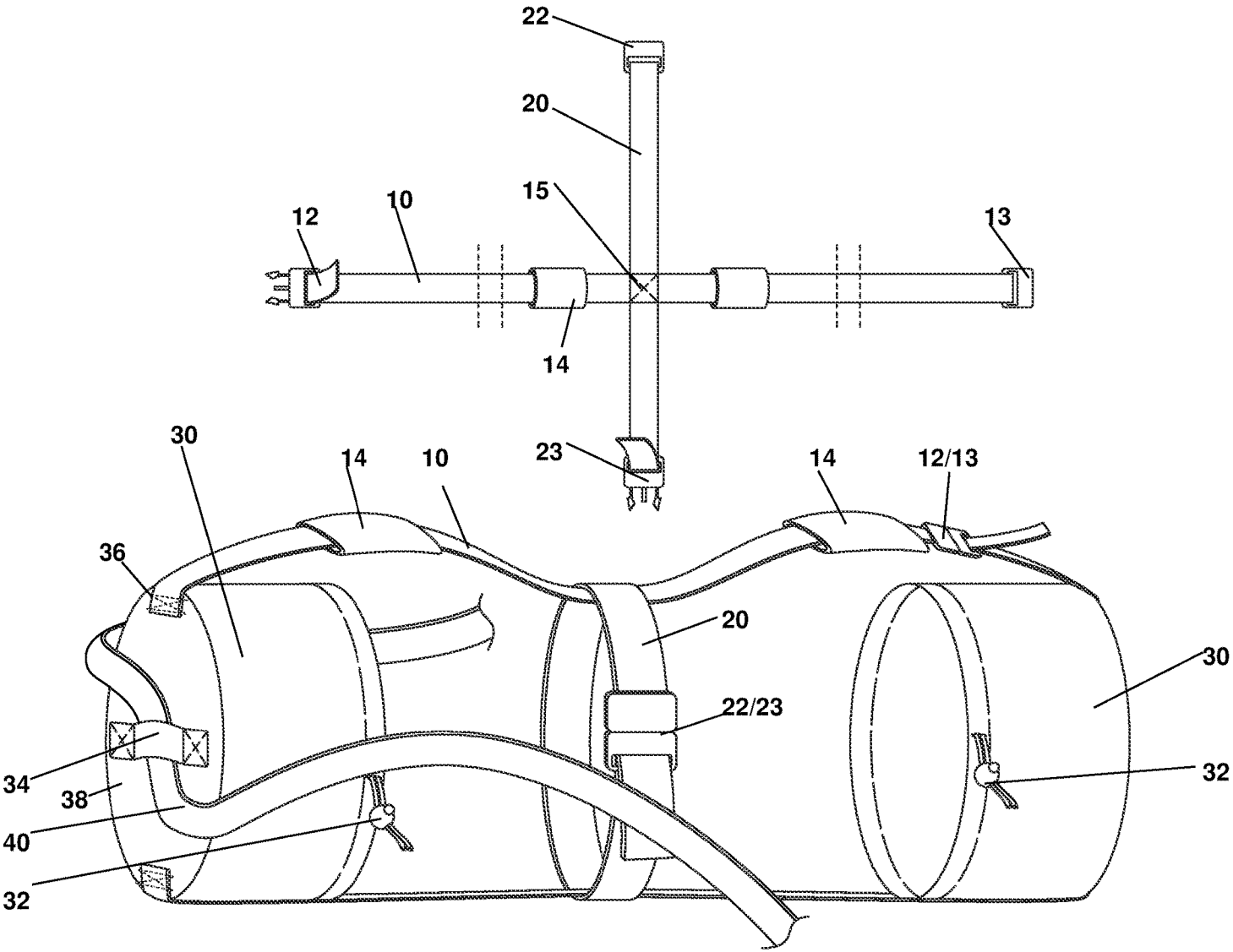
FIG. 1 shows a lumber carrier in a plan view and connected around two hollow cylinders and in an elevation view of an embodiment of the disclosed technology.

FIG. 1 shows a lumber carrier in a plan view and connected around two hollow cylinders and in an elevation view of an embodiment of the disclosed technology. A first adjustable length flexible strap, or as used hereinafter, a first strap 10 is fixedly connected to a second adjustable length strap, or as used herein after, a transverse strap 20. The transverse strap 20 is, in embodiments of the disclosed technology, at a right angle to the first strap 10. The straps are fixedly connected at an overlapping region 15 where the straps are sewn together or otherwise form one unit. The overlapping region 15, in varying embodiments, can be fixedly connected, removably connected, or unconnected (between the two straps). Spacers of a handle 14 or handle 14 are used in embodiments of the disclosed technology to distance at least part of the first strap 10 from lumber and prevent fraying of the strap and allow more maneuverability of the strap relative to the lumber as the spacers 14 are movable along the strap 10 (slidably movable). The connectors 12 and 13 of the first strap 10 can removably connect to each other such that the strap 10 forms a closed loop when the ends 12 and 13 and connected to one another. These connectors 12 and 13 can be buckles, hook and loop fastener, knots, or the like and the length of the circumferential region (loop) of the strap 10 can be adjusted using the connectors in embodiments of the disclosed technology. In this manner the length of the strap 10 can be adjusted such that the strap surrounds/is long enough to surround a length of lumber while the straps pass around and/or connect to end cups (caps) 30. Likewise, the transverse strap 20 has end connectors 22 and 23 which can be any of the type described with reference to the connectors 12 and 13 and can be used to adjust the length of a circumferential region of the transverse strap 20 to surround lumber.

It should be understood that while the term "lumber" is used, this applies not only to a board of wood. The terminology is a general term which applies to any elongated length of material or combinations thereof which each have a substantially equal length and whose ends, in combination, fit within an opening of an end cup 30. This can includes lengths of wood, metal, plastic, finished products, or a combination thereof.

Referring still to FIG. 1, in the perspective view the end cups 30 are seen at left and right sides (relative to the page). These cups 30 are oppositely disposed such that openings into each respective cup 30 face towards one another. These openings are used to hold opposite ends of lumber therein. The strap 10 is adjusted in length such that the cups are held around each end of the lumber preventing or better preventing the lumber from damaging an object that is hit therewith by providing a blunt end cap/cover on the lumber. In the version shown in FIG. 1 the first strap 10 extends to the circumferential sides of the end cups 30 (the number "30" has been placed on the circumferential side) and can extend to a back or rear side 38 of one or both of the cups. The first strap 10 can be fixedly, slidably, abuttedly attached to the circumferential side of the cup(s) 30. The first strap 10 can be fixedly, slidably, or abuttedly attached to the rear side 38 of the cup. The rear side can be flat and can be circular. "Abuttedly" is defined as "frictionally placed against". Shown here, an end of the strap 10 is fixedly attached at point 36 to one of the cups 30. On the other end, unseen, the strap 10 slides through a Ipp 34 found on one or more of the cups 30. The cups can be substantially identical to each other in embodiments of the disclosed technology.

The cups 30, described in more detail, have circumferential sides meaning that there are a plurality of adjoined circular cross sections with one cross section being filled or solid and the rest being open or empty forming a portal there-through on one side and a closed opposite side. It should be understood that "circle" can be "substantially circular" and this circular shape can be temporary or when the fabric/material is evenly stretched into the form shown in the figures or an otherwise non-collapsed version of the cup 30. The closed side 38 of the cup 30 is placed at a side furthest away from a corresponding closed side 38 of another substantially equally sized cup such that the openings face towards each other and each are positioned to hold one of two opposite ends of lumber. The loop 34 allows for slidable passage of the first strap 10 or a tie-down strap 40. A drawstring 32 can be used to collapse or deform the circular shape of the cup 30 by tightening/restricting/partially closing an opening into the cup. This allows the cup to be tightened over lumber which only partially fills the opening into the cup 30.

Figure 2:
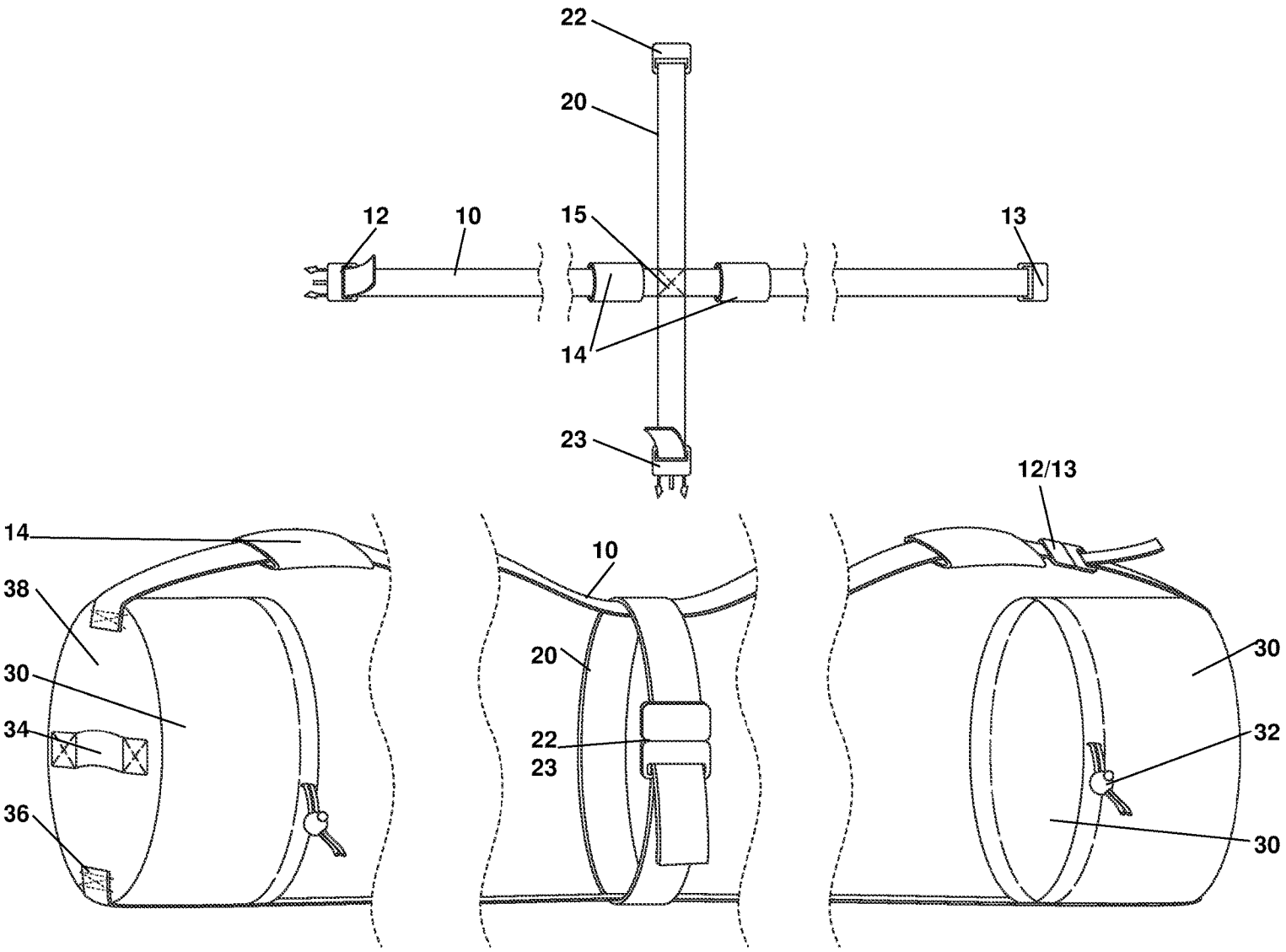
FIG. 2 shows another version a lumber carrier in a plan view and connected around two hollow cylinders in an elevation view of an embodiment of the disclosed technology.

FIG. 2 shows another version a lumber carrier in a plan view and connected around two hollow cylinders in an elevation view of an embodiment of the disclosed technology. In this view it is shown that the strap 10 can be of any length such that the distance of the cups 30 can be set to accommodate any size lumber. The strap 10 is attached to one of the cups 30 at a back side 38 thereof in a fixed manner. The attachment to the opposite cup 30 can be the same as shown with respect to the first cup and can be slidable through a loop 34. The strap 20 can be adjusted using the adjustable length connectors 22/23 to set a length of the strap 20 to be only slightly larger than a circumference of lumber held there-between. "Slightly" is defined as "within 10% or within 20% of a smoothed circumference of items modified by the term."

Figure 3:
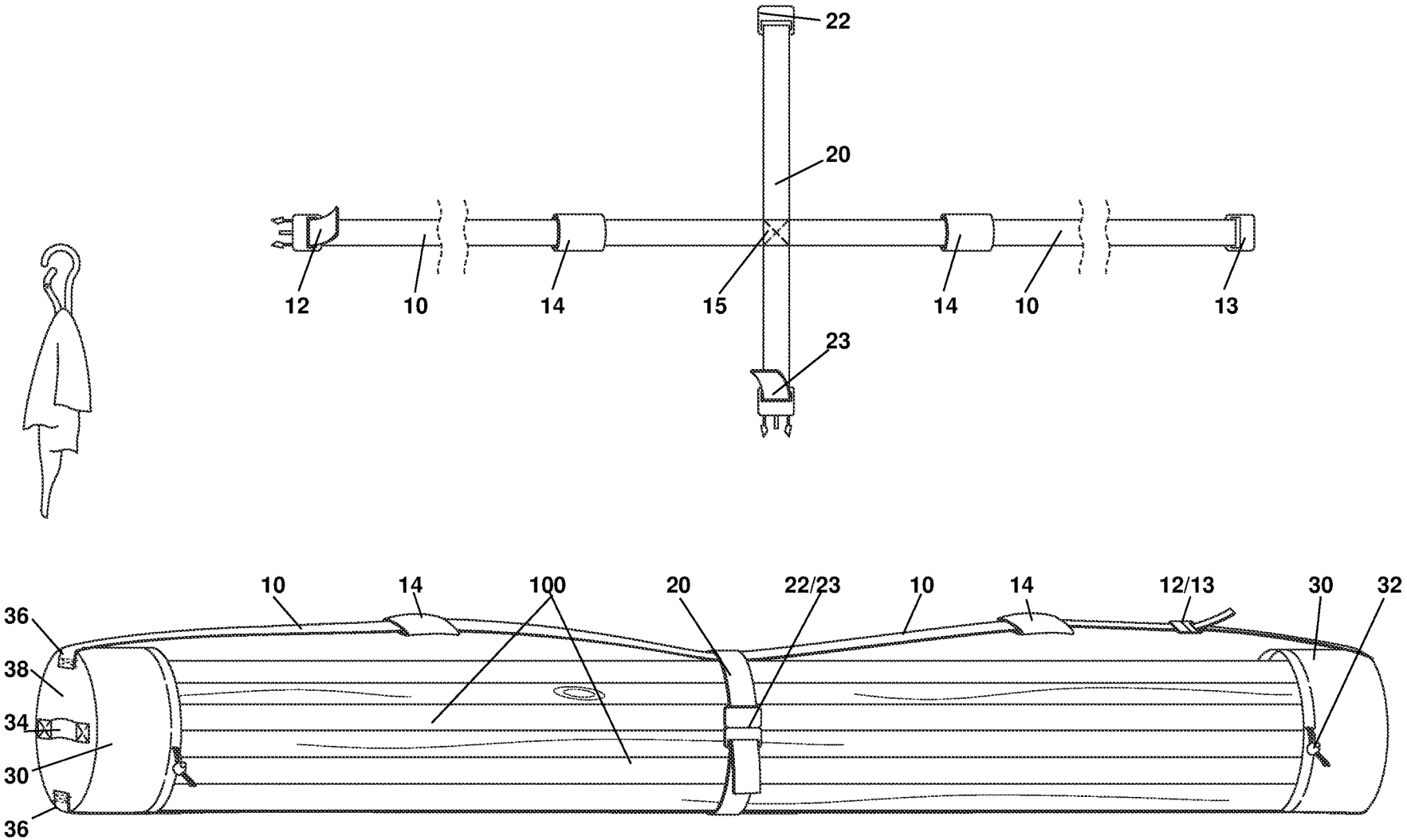
FIG. 3 shows a first and second adjustable strap in a plan view and a perspective view showing the first and second adjustable strap used to carry lumber in an embodiment of the disclosed technology.

FIG. 3 shows a first and second adjustable strap in a plan view and a perspective view showing the first and second adjustable strap used to carry lumber in an embodiment of the disclosed technology. Here, lumber 100 is seen held within the cups 30, the cups being tightened by way of draw string 32 around the lumber. The transverse strap 20 is further used to hold the lumber carrying device taut around the lumber at a midpoint between the cups 30. As such the transverse strap 20 extends circumferentially in parallel to the circumferential sides of the cups 30. The strap 10 then extends along one side of the lumber, or alternatively, along two sides of the lumber such as two opposite elongated sides. The "elongated" sides for purposes of this disclosure are defined as, "a longest linear extent of an object between two oppositely disposed end points of said object." The longest linear extent can be one which is between two substantially flat sides while an external side of the object between the two substantially flat sides is planar such as in the case of a prism-shaped piece of lumber. Note that the handles 14 can also serve as attachment points for another loop to pass there-through and form a handle.

Figure 4:
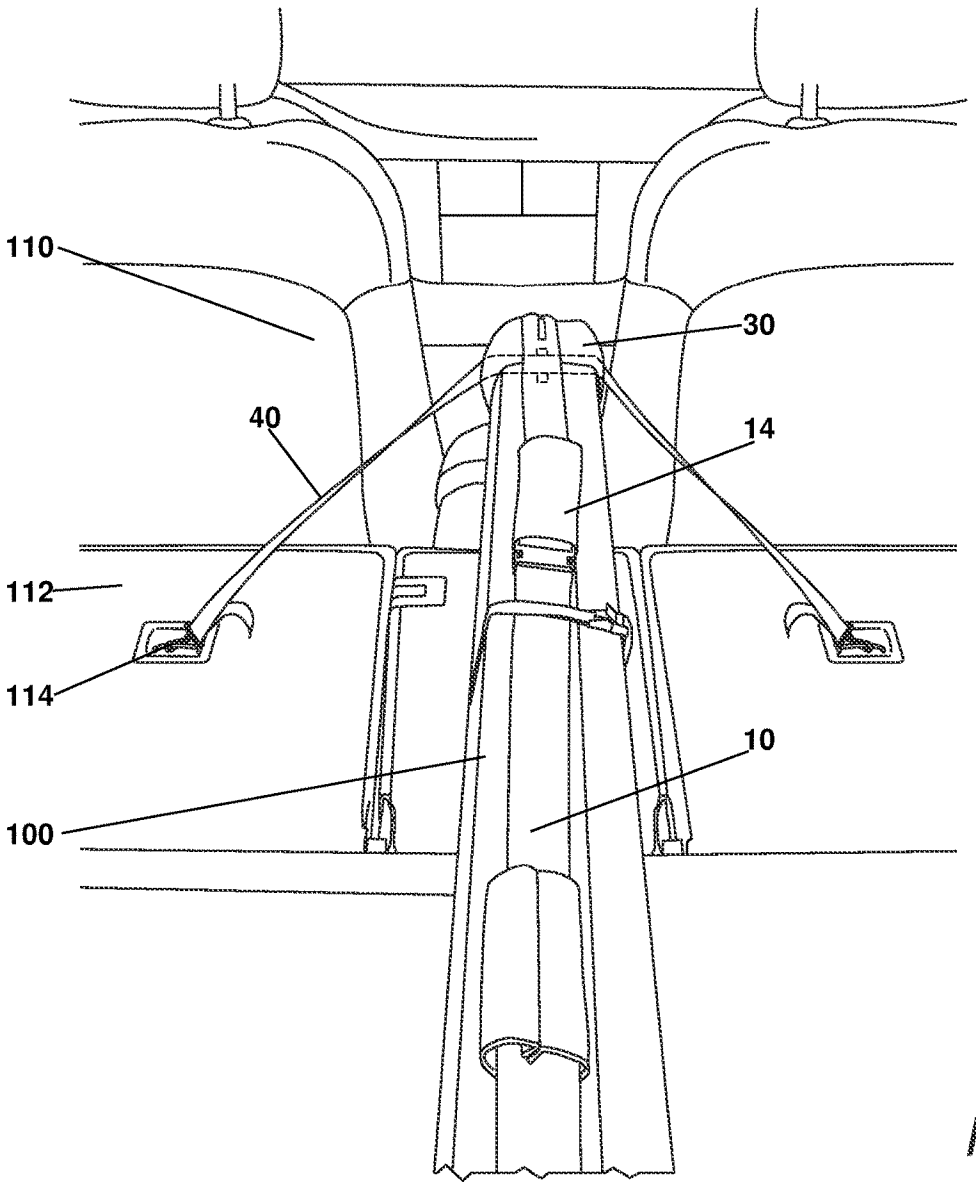
FIG. 4 shows a lumber carrier being used to securely hold lumber in a vehicle in an embodiment of the disclosed technology.

FIG. 4 shows a lumber carrier being used to securely hold lumber in a vehicle in an embodiment of the disclosed technology. A tie-down strap 40 is used, in this case passing through a loop of an end cap 30 though the strap 40 could pass through a loop 14 or between the lumber 100 and the first strap 10. The lumber 100 shown is multiple pieces of lumber which are prison-shaped lumber. The lumber is thus placed between rear seats 112 and, in some embodiments, front seats 110 of a vehicle as shown. This is one way in which the lumber carrier can be used in that the lumber, skis, or other device, can be prevented from doing damage by capping the ends with the caps 30 while the objects (lumber, skis, etc.) are fixed to one another to form a single bundle. In some embodiments the bundle is secured at a forward side preventing moving towards a front of the vehicle when the vehicle brakes/decelerates. This bundle is a combination of pieces of lumber or other objects held together by the transverse strap 20 and cups 30 and tied town with a tie-down strap 40 in some embodiments. The bundle can additionally or instead be connected to a latch found at a back side of a seat of a vehicle.

Any device or step to a method described in this disclosure can comprise or consist of that which it is a part of, or the parts which make up the device or step. The term "and/or" is inclusive of the items which it joins linguistically and each item by itself.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

What is claimed is:

1. A dual-ended cup based lumber carrier comprising:

two end cups each with an open front side and a closed back side, wherein said open front sides face each other;

a portal on each said closed back side;

an adjustable length flexible strap passing through each said portal of each said closed back side;

a transverse flexible strap fixedly attached to said adjustable length flexible strap forming a loop equidistantly connected at two spaced apart locations between each of said two end cups;

wherein each of said open front sides has a circular cross-section;

wherein said adjustable length flexible strap extends around oppositely disposed sides of a side wall of each said end cup; and wherein a prism-shaped lumber is placed between, and inserted into, each of said two end cups.

2. The lumber carrier of claim 1, further comprising a handle slidably connected, at two spaced apart positions, to said adjustable length flexible strap.

3. The lumber carrier of claim 1, wherein said adjustable length flexible strap is slidably connected to said oppositely disposed sides of said side wall of each said end cup.

4. The lumber carrier of claim 1, wherein said circular cross-section is deformable by way of a circumferentially placed drawstring adapted to tighten at least one of said end cups around said prism-shaped lumber.

5. A dual-ended cup based lumber carrier system comprising:

two identical end cups with an open end opposite a closed end;

two adjustable length flexible straps fixedly attached at a center point of each said two adjustable length flexible straps in a transverse manner to each other;

a loop fixed to said closed end of each of said two identical end cups;

wherein said dual-ended cup based lumber carrier is adapted to carry lumber placed within each said open end of each of said two identical end cups when one of said two adjustable length flexible straps is passed through each said loop fixed to said closed end of each of said two identical cups, and wherein a first adjustable strap of said two adjustable length straps is attached to itself by way of a removable connector forming a length of substantially double of said length of lumber desired to be placed or placed within each said open end of each said end cup.

6. The system of claim 5, wherein a second adjustable strap of said two adjustable length flexible straps is formable into a closed loop having a diameter substantially equal to each said open end of each said end cup.

7. The system of claim 6, wherein each said end cup and said second adjustable strap surround multiple pieces of lumber.

8. The system of claim 5, further comprising a looped handle placed between each of two loops of a first said adjustable strap of said two adjustable length flexible straps, wherein each of said two loops is affixed to said first adjustable strap.

9. The system of claim 8, wherein said looped handle is slidable affixed within each of said two loops of said first adjustable strap of said two adjustable length flexible straps.

10. The system of claim 8, wherein each said two loops is slidably connected to said first said adjustable strap of said two adjustable length flexible straps.

11. The system of claim 8, wherein said each of said two loops of said first adjustable strap is equidistant from said center point.

12. A dual-ended cup based lumber carrier comprising:

two hollow cylinders made of flexible material having a single open circular side, said single open circular side of each of said two hollow cylinders proximal and spaced apart from each other;

a strap extending around a distal side of each said two hollow cylinders and slidable or fixedly attached therefrom said strap forming and adjustably sized closed loop, two connecting mechanisms on said adjustably sized close loop spaced apart from each of said two hollow cylinders; and a second closed loop of flexible material attached to each of said connecting mechanisms, said second closed loop within an identical plane as said adjustably sized closed loop such that openings surrounded by the respective said loops are facing in a same orientation.

13. The dual-ended cup based lumber carrier of claim 12, further comprising:

a transverse loop fixedly connected to said strap equidistant between and parallel to each round side wall of each said two hollow cylinders.

14. The dual-ended cup based lumber carrier of claim 13, wherein a maximum distance between each of said two hollow cylinders is determined based on a length of said strap extending around said distal side of each of said two hollow cylinders.

15. The dual-ended cup based lumber carrier of claim 14, wherein each of said two hollow cylinders is slidably connected to said strap.

* * * * *